US007159557B2

(12) United States Patent
Yasuda et al.

(10) Patent No.: US 7,159,557 B2
(45) Date of Patent: Jan. 9, 2007

(54) AIR INTAKE DEVICE

(75) Inventors: Kazuhiro Yasuda, Wako (JP); Tadashi Oshima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/798,513

(22) Filed: Mar. 10, 2004

(65) Prior Publication Data

US 2004/0187828 A1 Sep. 30, 2004

(30) Foreign Application Priority Data

Mar. 10, 2003 (JP) ..... 2003-062829

(51) Int. Cl.
*F02M 35/10* (2006.01)
*F02M 35/16* (2006.01)
*F02M 35/12* (2006.01)

(52) U.S. Cl. ..... 123/184.57

(58) Field of Classification Search ..... 123/184.57; 181/204

See application file for complete search history.

(56) References Cited

U.S. PATENT DOCUMENTS 4,254,746 A 3/1981 Chiba et al.
4,539,947 A * 9/1985 Sawada et al. ..... 123/184.57
4,546,733 A * 10/1985 Fukami et al. ..... 123/184.57
5,002,021 A * 3/1991 Nakata et al. ..... 123/184.42
6,105,547 A 8/2000 Sakamoto
6,155,224 A * 12/2000 Akihisa et al. ..... 123/184.57
6,155,225 A * 12/2000 Suzuki ..... 123/184.57
6,230,677 B1 * 5/2001 Setsuda ..... 123/184.21
6,427,112 B1 * 7/2002 Kostun ..... 701/111
6,600,408 B1 * 7/2003 Walter et al. ..... 340/384.1
6,609,489 B1 * 8/2003 Slopsema et al. ..... 123/184.57
6,655,337 B1 * 12/2003 Hirano et al. ..... 123/184.31

FOREIGN PATENT DOCUMENTS

EP 0 376 299 7/1990
EP 0 379 926 8/1990
JP 2001-073893 3/2001

* cited by examiner

*Primary Examiner*—Marguerite McMahon
(74) *Attorney, Agent, or Firm*—Hamre Schumann Mueller & Larson, PC

(57) ABSTRACT

The present invention relates to a vehicle's air intake device. In an embodiment, the intake device comprises an intake pipe, an air cleaner case in fluid communication with the intake pipe, a connection pipe in fluid communication with the air cleaner case, a carburetor attached to the connection pipe, and a plurality of resonators. In an embodiment, the intake device comprises an intake pipe, an air cleaner case in fluid communication with the intake pipe, a connection pipe in fluid communication with the air cleaner case, a carburetor attached to the connection pipe, and means for reducing intake sound levels.

10 Claims, 10 Drawing Sheets

AIR INTAKE DEVICE

FIELD OF THE INVENTION

The present invention relates to an air intake device.

BACKGROUND OF THE INVENTION

Air intake devices that can reduce air intake sounds with the use of a resonator provided at the intake pipe are known (e.g., JP-A 73893/2001). By way of example, FIG. 10 is a side view of a typical intake pipe 200 of a vehicle's intake device as would be installed in an off-road vehicle.

The intake pipe 200 has a main opening 202 at its side wall 201 and a resonator 203 covers this main opening 202. The resonator 203 has a drain hole 204 that communicates externally. Particularly, the resonator 203 provided at the intake pipe 200 is used to suppress pulsation, thereby reducing air intake sounds. Arrows in FIG. 10 denote air flow.

Generally, a large resonator is required to reduce air intake sounds from a vehicle's intake device. However, when a large capacity resonator must be provided at the intake pipe, the layout options for the intake pipe are limited significantly. Therefore, a need exists for an intake device offering design flexibility.

SUMMARY OF THE INVENTION

In an embodiment, the intake device comprises an intake pipe, an air cleaner case in fluid communication with the intake pipe, a connection pipe in fluid communication with the air cleaner case, a carburetor attached to the connection pipe, and a plurality of resonators. In an embodiment, the intake device comprises an intake pipe, an air cleaner case in fluid communication with the intake pipe, a connection pipe in fluid communication with the air cleaner case, a carburetor attached to the connection pipe, and means for reducing intake sound levels.

The above summary of the present invention is not intended to describe each discussed embodiment of the present invention. This is the purpose of the figures and the detailed description that follows.

DRAWINGS

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION

Figure 10:
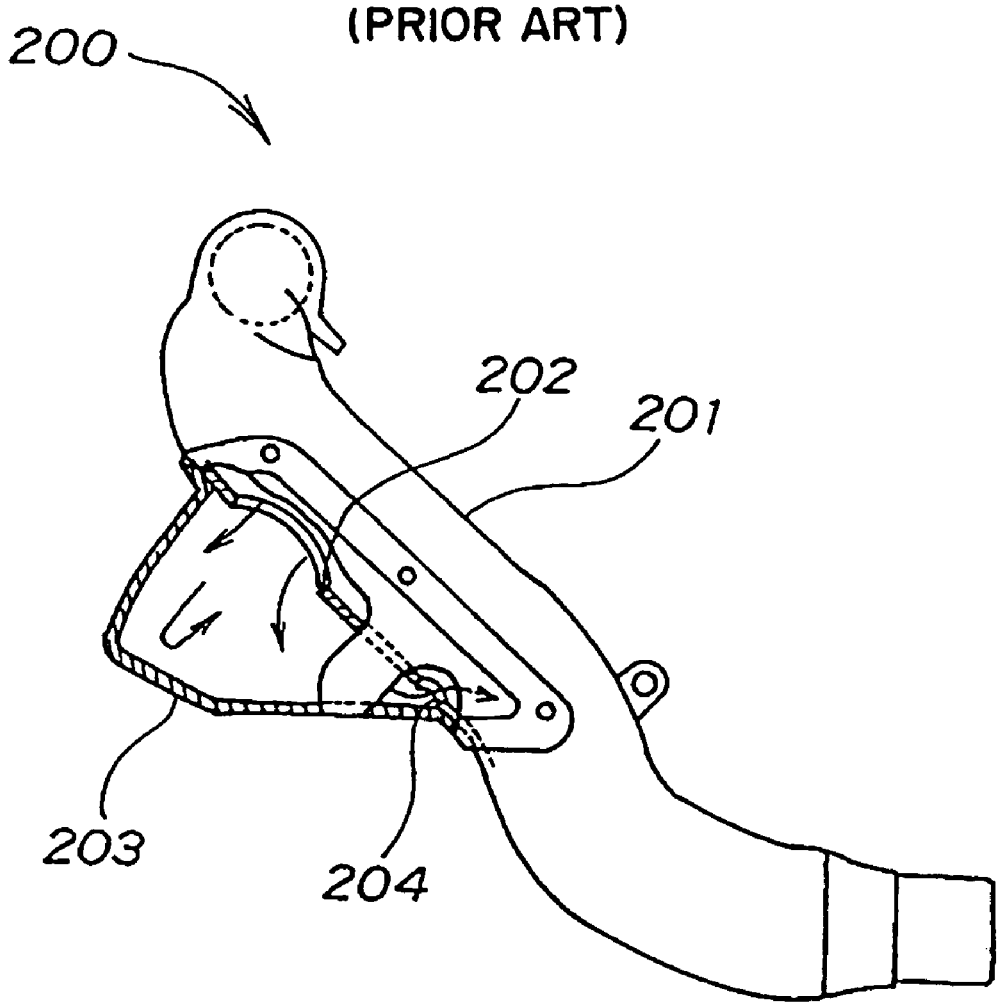
FIG.10 (PRIOR ART)
FIG. 10 is identical to FIG. 1 of the official gazette of JP-A No. 73893/2001.

An intake pipe for use with an off-road vehicle should be designed in due consideration of cases in which the vehicle might run in shallows of rivers and marshlands, so that the intake pipe is not inundated when running in water. For example, referring to FIG. 10, the intake pipe 200 is disposed between supplemental devices so as to form the opening of the intake pipe in an upper portion of the vehicle. However, when a large capacity resonator 203 must be provided at the intake pipe 200, the layout options for the intake pipe are limited significantly.

In an embodiment, the present invention provides a vehicle's intake device that can increase the capacity of the resonator even in a limited layout so as to reduce the air intake sounds. If each of the resonators can have a sufficient capacity even in a limited layout space, it will be able to reduce air intake sounds sufficiently.

In an embodiment, the first resonator is provided at the intake pipe and the second resonator is provided at the connection pipe to reduce air intake sounds respectively. Because, in an embodiment, the intake pipe is provided with the first resonator and the connection pipe is provided with the second resonator, each of the resonators has a sufficient capacity. Consequently, pulsation is suppressed in each of the intake and connection pipes, thereby air intake sounds are reduced in those pipes.

Generally, it is rare that an intake device has only one resonant frequency; usually, an intake device has a plurality of resonance frequencies. In an embodiment, the intake pipe is provided with a first resonator, reducing air intake sounds resonant with one specific frequency band and the connection pipe is provided with a second resonator, reducing air intake sounds resonant with another specific frequency band. Therefore, in an embodiment, the present invention can reduce air intake sounds in a plurality of frequency bands simultaneously.

Generally, a dead space exists between a carburetor and an air cleaner case. In an embodiment, the second resonator is formed in such a space located in front of the air cleaner case and at a side of the connection pipe in the intake device of the present invention. Therefore, the dead space between the carburetor and the air cleaner case can be utilized effectively.

In an embodiment, the first and second resonators are settled in the width of the air cleaner case. Therefore, the first and second resonators are prevented from interfering other parts disposed around there. Consequently, the vehicle's intake device is installed easily in the subject vehicle.

Figure 1:
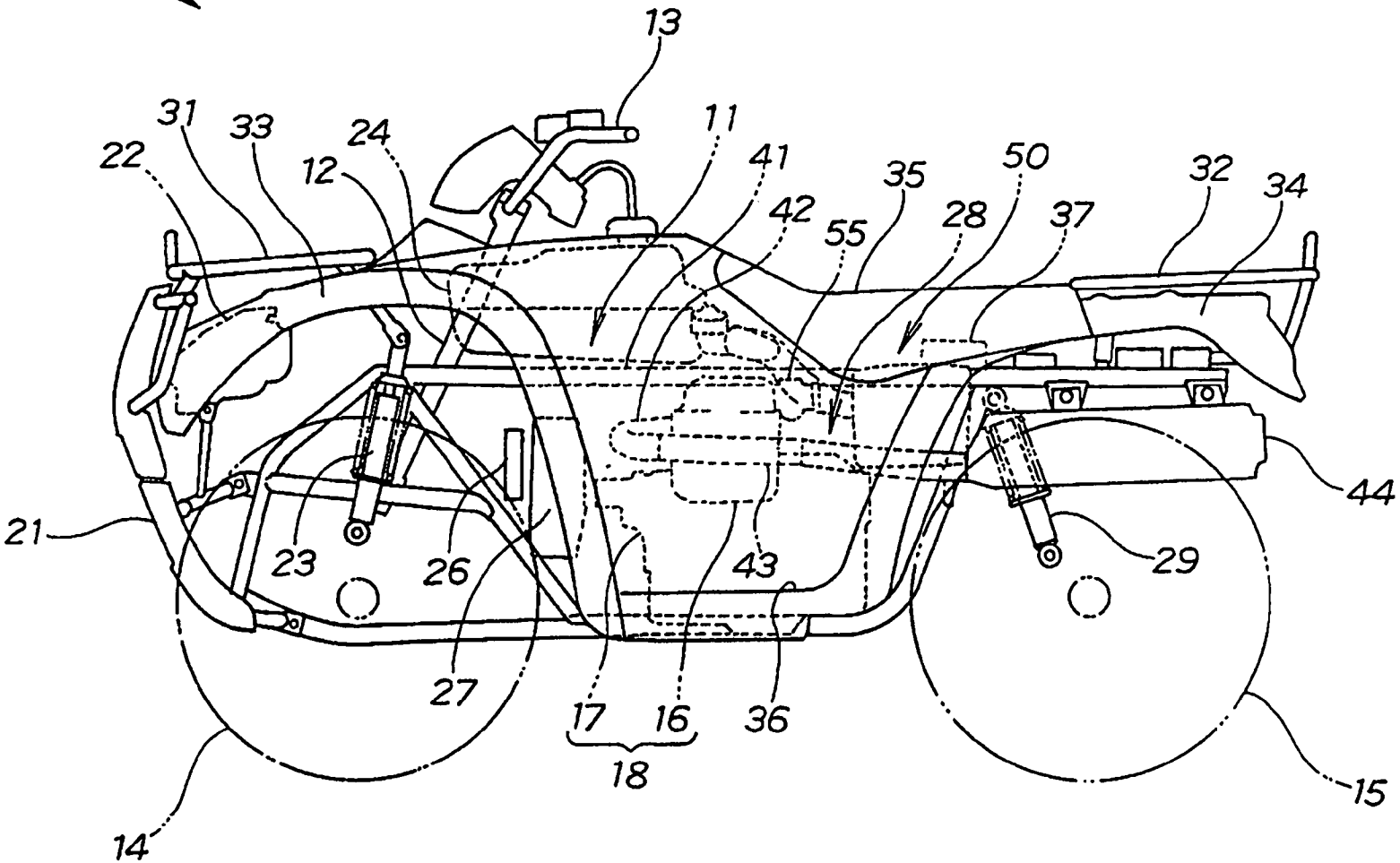
FIG. 1 is a side view of a vehicle in which an intake device of the present invention is installed.

Referring now to FIG. 1, a side view of an off-road vehicle is shown in which the intake device of the present invention is installed. In the vehicle 10, a steering wheel post 12 is attached to a front part of a vehicle frame 11. A steering wheel 13 is attached rotationally at the top end of the steering wheel post 12. Right and left front wheels 14 (the other side wheel 14 is not shown) are attached rotationally to the front lower end of the vehicle frame 11. Right and left rear wheels 15 (the other side wheel 15 is not shown) are attached rotationally to the rear lower end of the vehicle frame 11. A power unit 18 is attached to a middle point of the vehicle frame 11 to drive those front wheels 14, as well as rear wheels 15. The power unit 18 consists of an engine 16 and a transmission 17.

In FIG. 1, reference numerals are defined as follows; 21 denotes a front guard for protecting the front side of the vehicle, 22 denotes headlamps, 23 denotes a cushion unit (a shock absorber) of front wheels 14, 24 denotes a fuel tank attached to the vehicle frame 11, 26 denotes an oil cooler, 27 denotes a shroud for enclosing a fan of the oil cooler 26, 28 denotes an exhaustion device connected to the front part of the engine 16, 29 denotes another cushion unit for the rear wheels 15, 31 denotes a front carrier on which things are placed, 32 denotes a rear carrier on which things are placed, 33 denotes a front fender for covering both upper and rear portions of the front wheels 14, 34 denotes a rear fender for covering both front and upper portion of the rear wheels 15, 35 denotes a sheet, 36 denotes a step on which the driver puts his/her foot, and 37 denotes a battery. Reference numeral 50 denotes the vehicle's intake device of the present invention.

Figure 2:
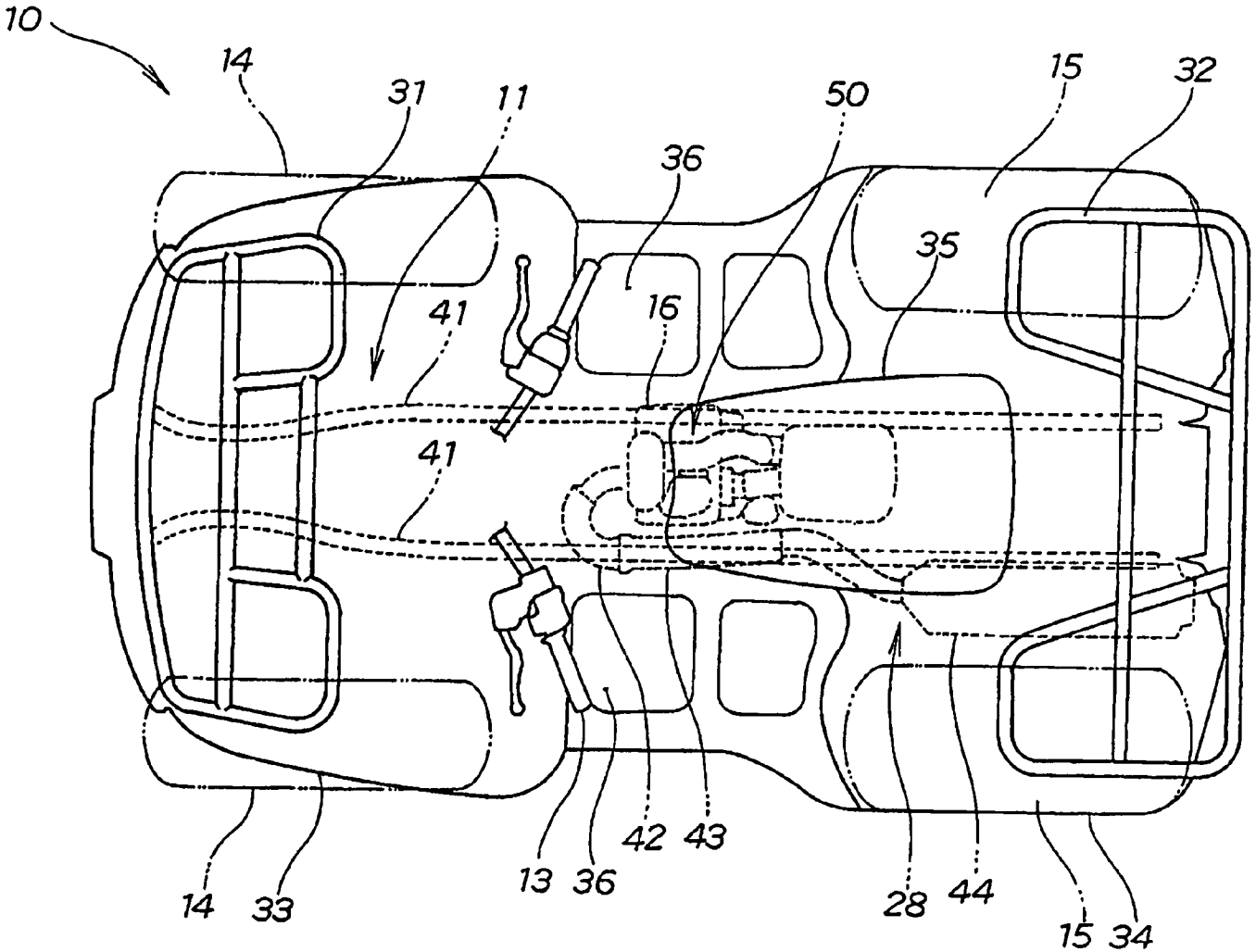
FIG. 2 is a top view of the vehicle in which the intake device of the present invention is installed.

FIG. 2 shows a top view of the vehicle in which the intake device of the present invention is installed. In FIG. 2, right and left main frames 41 of the vehicle frame 11 are disposed so as to be extended in the front and rear directions from the center of the vehicle body and the engine 16 and the vehicle's intake device 50 are disposed between those main frames 41.

The exhausting device 28 is configured by a U-shaped exhaust pipe 42, a middle exhaust pipe 43 connected to the tip of the exhaust pipe 42, and a muffler 44 attached to the tip of the middle exhaust pipe 43. In FIG. 2, the exhaust pipe 42 is bent like a U letter and extended to the rear from the engine 16 through the middle exhaust pipe 43.

Figure 3:
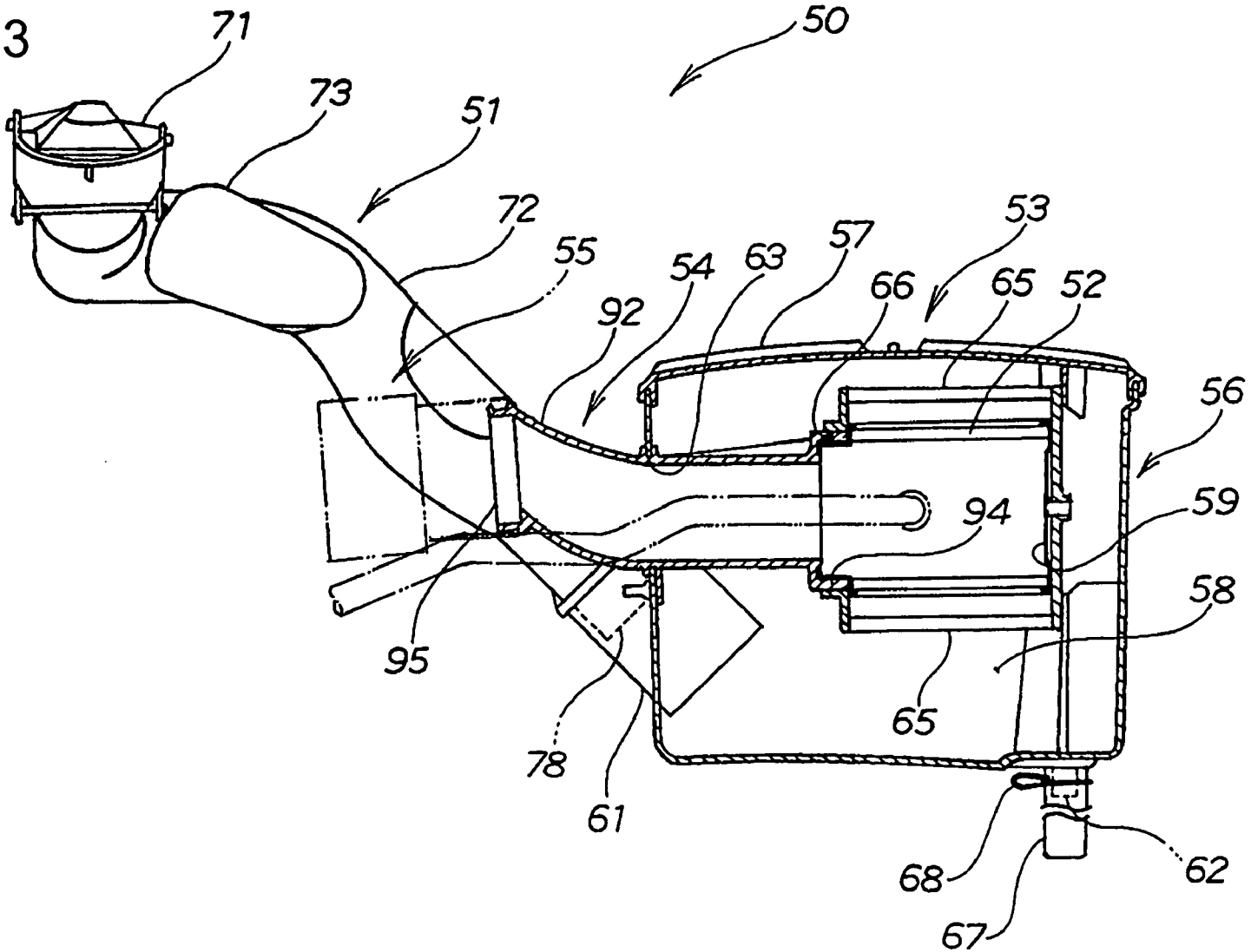
FIG. 3 is a side view of the intake device of the present invention.

FIG. 3 shows a side view of the vehicle's intake device of the present invention. The intake device 50 is configured by an intake pipe 51 for taking air in, an air cleaner case 53 provided with an air cleaner 52 attached to the intake pipe 51 and used to clean the air, a connection pipe 54 extended from the air cleaner case 53, a carburetor 55 attached to the tip of the connection pipe 54 and used to supply a fuel to the engine 16 (FIG. 1).

The air cleaner case 53 is configured by a case body 56 and a case cover 57 for covering the case body 56. The case body 56 is configured by a first chamber 58 for flowing the air through the intake pipe and a second chamber 59 provided with an air cleaner 52 for cleaning the air.

The first chamber 58 is configured by an intake pipe connection part 61 for connecting the intake pipe 51, a drain port 62 for draining water contained in the air, and a connection pipe through-hole 63 through which the connection pipe 54 is passed. The second chamber 59 is configured by intake ports 65 for taking air into the air cleaner 52, and a connection pipe connecting port 66 for connecting the connection pipe 54.

In FIG. 3, other reference numerals are defined as follows; 67 denotes a drain hose connected to the drain port 62 and 68 denotes a clip for clipping the drain hose 67 to the drain port 62.

Figure 4:
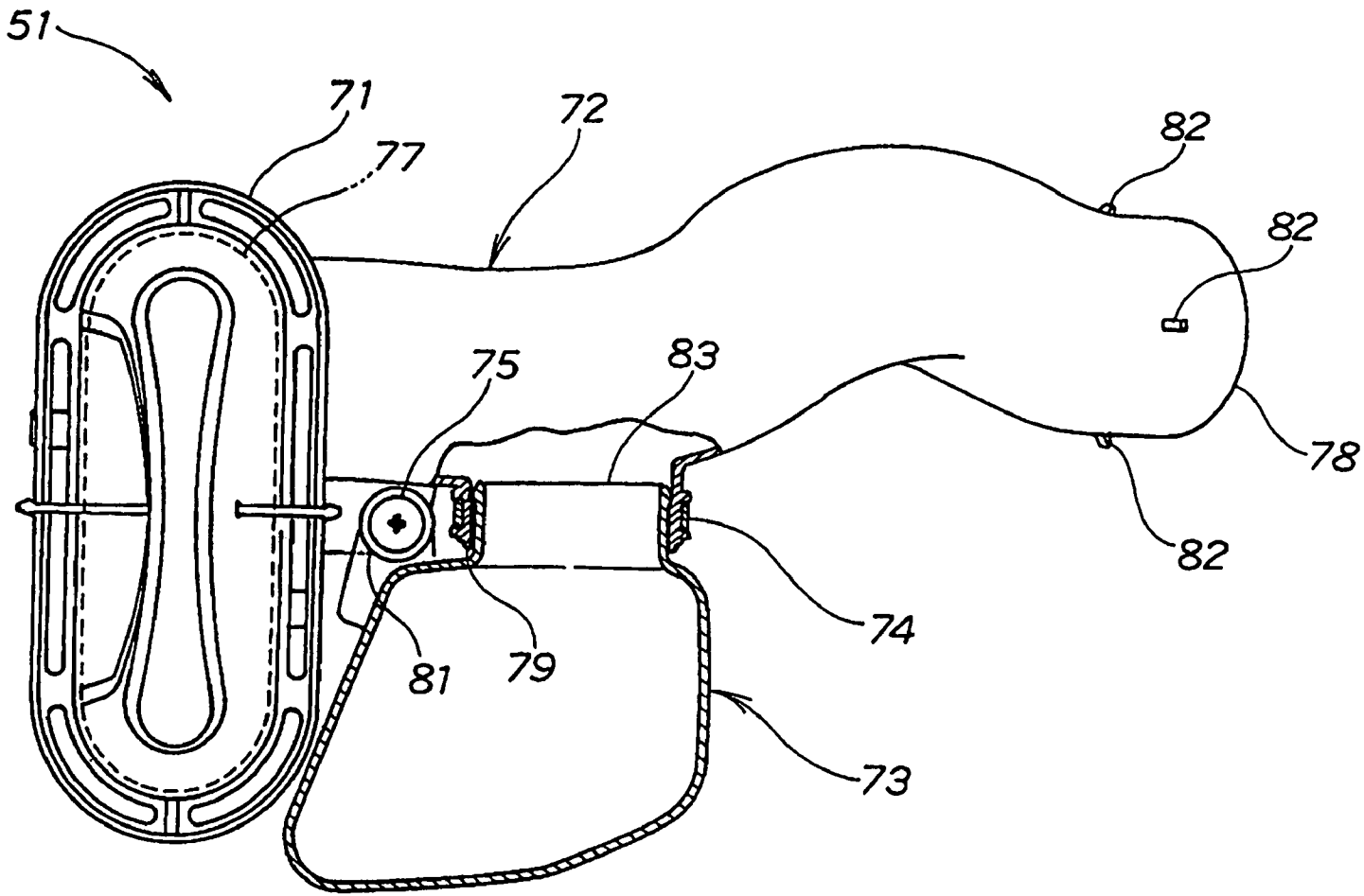
FIG. 4 is a top view of an intake pipe of the vehicle in which the intake device of the present invention is installed.

FIG. 4 shows a top view of the intake pipe of the vehicle's intake device of the present invention. The intake pipe 51 is configured by an opening cover (louver) 71 for regulating the air flow, an intake pipe body 72 for flowing the air taken in through the opening louver 71, and a first resonator 73 attached at a middle point of the intake pipe body 72 and used to reduce air intake sounds.

In FIG. 4, other reference numerals are defined as follows; 74 denotes a band for fastening the first resonator 73 to the intake pipe body 72 and 75 denotes a screw for fastening the first resonator 73 to the intake pipe body 72.

The body of the intake pipe 72 is configured by an inlet side opening 77 for fastening the opening cover 71, an outlet side opening 78 facing the case body 56 of the air cleaner case 53, a first resonator side opening 79 facing the first resonator 73, a support part 81 for supporting the first resonator 73, and a plurality of outlet side opening stoppers 82 coming into the case body 56 of the air cleaner case 53 respectively. The first resonator 73 is provided with an intake pipe fitting port 83 that is fit in the first resonator side opening 79 of the intake pipe body 72.

Figure 5:
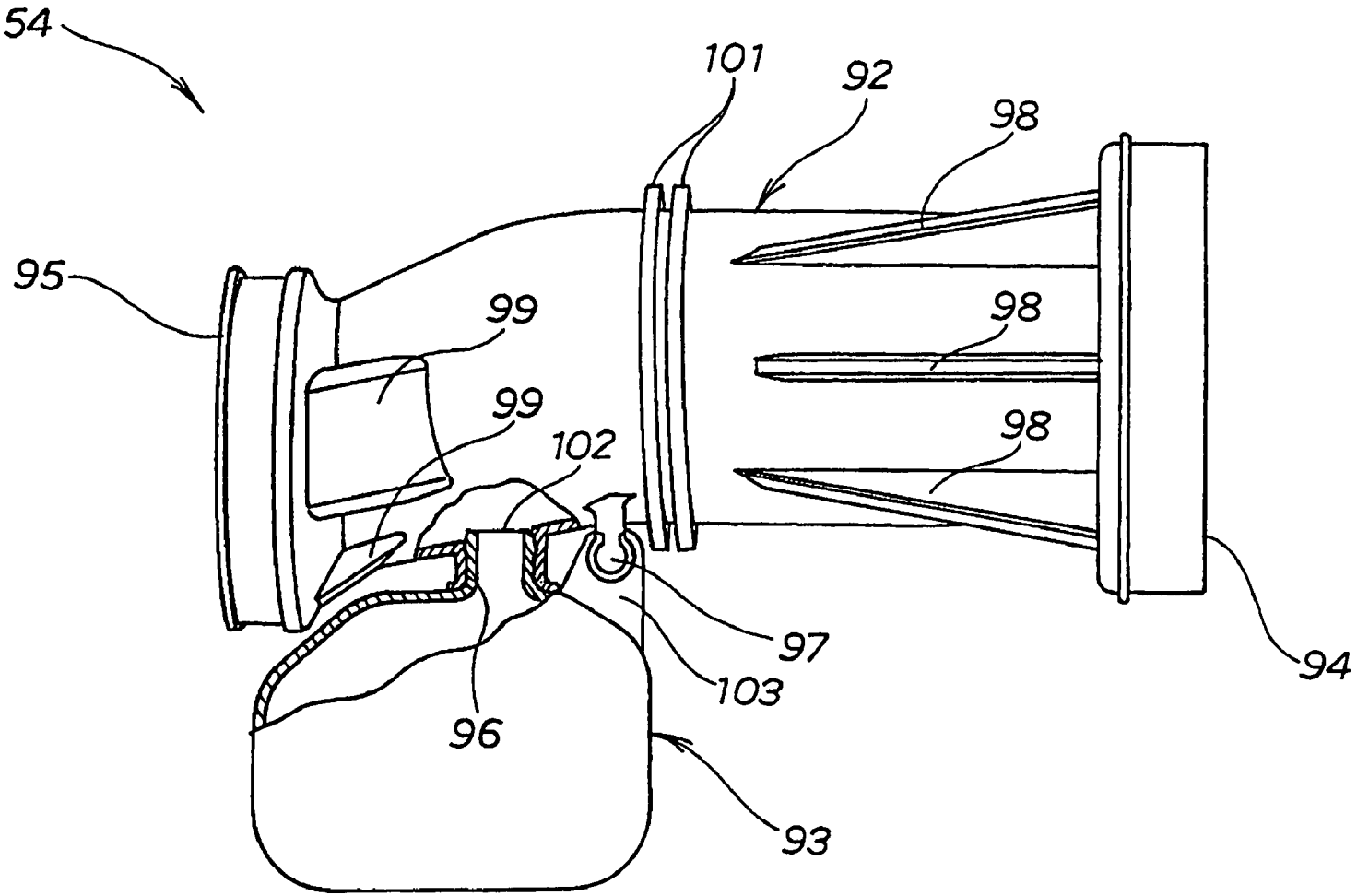
FIG. 5 is a top view of a connection pipe of the vehicle in which the intake device of the present invention is installed.

FIG. 5 shows a top view of the connection pipe of the vehicle's intake device of the present invention. The connection pipe 54 is configured by a connection pipe body 92 and a second resonator 93 attached at a middle point of the connection pipe body 92 and used to reduce air intake sounds.

The connection pipe body 92 is configured by a case side opening 94 provided at the case body 56 of the air cleaner case 53 (FIG. 3), a carburetor side opening 95 provided at the carburetor 55 (FIG. 3), and a second resonator side opening 96 facing the second resonator 93, and a projection 97 to be fit in the second resonator 93.

In FIG. 5, reference numerals are defined as follows; 98 and 99 denote reinforcement ribs for improving the hardness of the connection pipe body 92 and 101 denotes a case fitting part to be fit in the connection pipe through-hole 63 of the case body 56. The second resonator 93 includes a connection pipe fitting port 102 to be fit in the second resonator side opening 96 of the connection pipe body 92 and a locking part 103 locked by the projection 97 of the connection pipe body 92.

Figure 6:
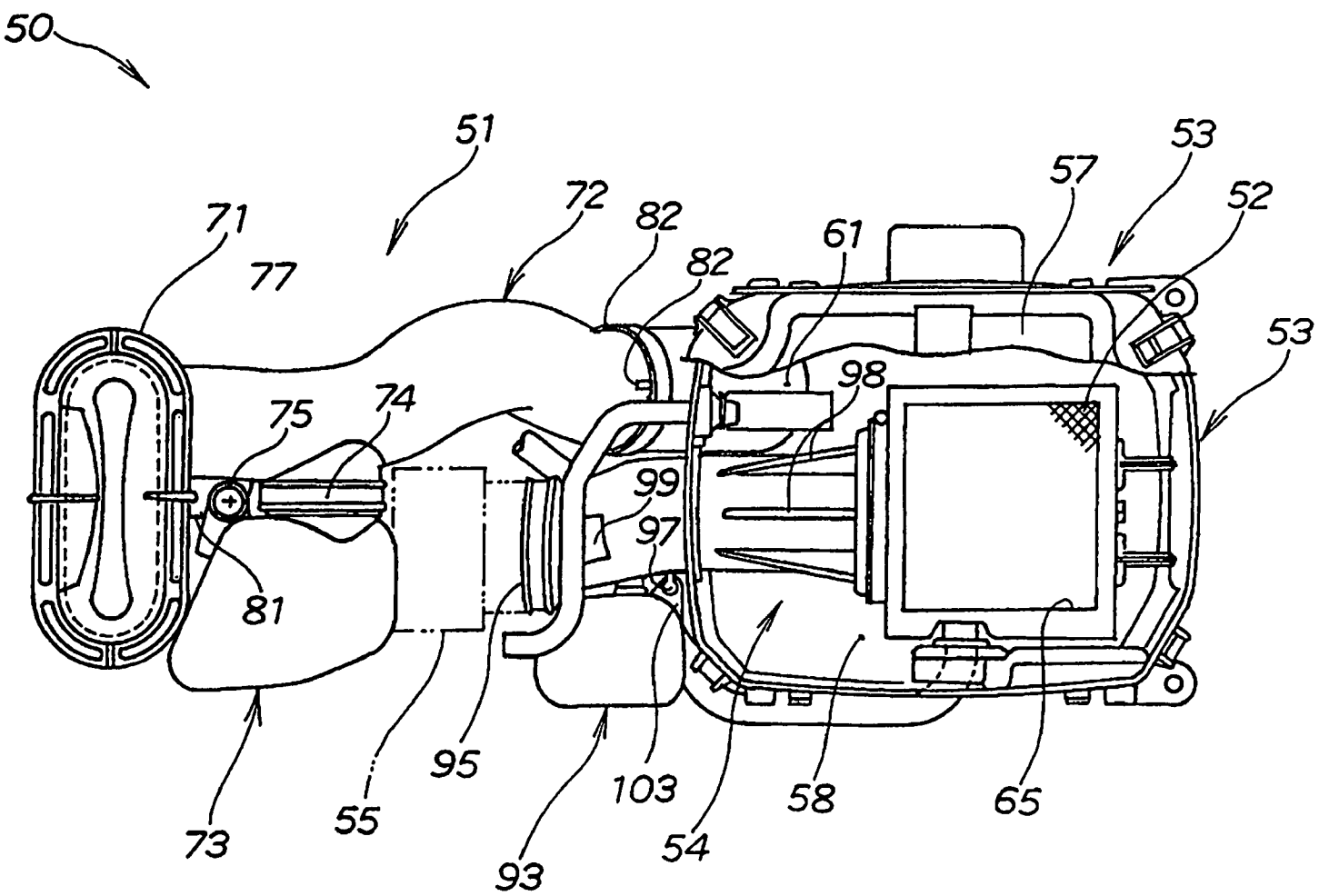
FIG. 6 is a top view of the intake device of the present invention.

FIG. 6 shows a top view of the vehicle's intake device of the present invention. The intake device 50 is configured by an intake pipe 51 for taking air in, an air cleaner case 53 provided with an air cleaner 52 attached to the intake pipe 51 and used to clean the air, a connection pipe 54 extended from the air cleaner case 53, and a carburetor 55 attached to the tip of the connection pipe 54 and used to supply a fuel to an engine 16 (FIG. 1). In the vehicle's intake device 50, the intake pipe 51 is provided with a first resonator 73 for reducing air intake sounds and the connection pipe 54 is provided with a second resonator 93 for reducing air intake sounds.

If the capacity of the resonator is secured enough even in a limited layout space, the air intake sounds can be reduced. This is why the intake pipe 51 is provided with the first resonator 73 and the connection pipe 54 with the second resonator 93 for reducing air intake sounds respectively in the intake device of the present invention. Because the intake pipe 51 is provided with the first resonator 73 and the connection pipe 54 with the second resonator 93, each of the resonators 73 and 93 can have a sufficient capacity. Consequently, the device can suppress pulsation, thereby reducing air intake sounds.

Generally, an intake device has many resonant frequencies. In an embodiment, the intake pipe 51 is provided with the first resonator 73 to reduce intake sounds resonant to one specific frequency band and the connection pipe 54 is provided with the second resonator 93 to reduce intake sounds resonant to another specific frequency band. The device can thus reduce air intake sounds in a plurality of frequency bands.

Generally, a dead space is often generated between the carburetor and the air cleaner case in each intake device. In an embodiment, the second resonator 93 is formed in such a dead space located in front of the air cleaner case 53 and at a side of the connection pipe 54 to utilize the dead space between the carburetor 55 and the air cleaner 53 effectively.

Figure 7:
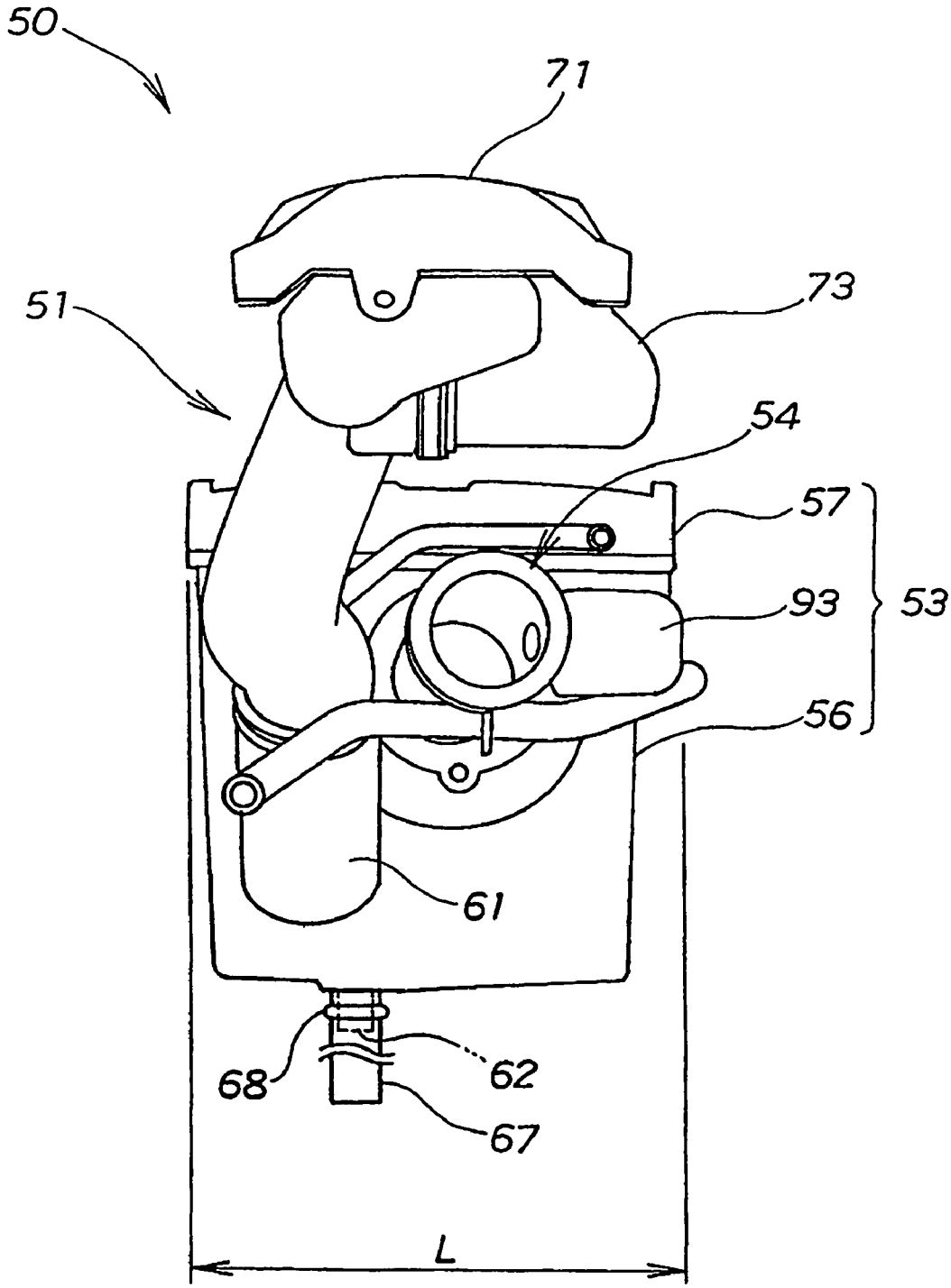
FIG. 7 is a front view of the intake device of the present invention.

FIG. 7 shows a front view of the vehicle's intake device of the present invention. The intake device 50 settles the first and second resonators 73 and 93 in the width L of the air cleaner case 53. Because the first and second resonators 73 and 93 are settled in the width L of the air cleaner case 53 such way, the first and second resonators 73 and 93 are prevented from interfering other parts disposed around there. Consequently, the vehicle's intake device 50 can be installed easily in a vehicle.

Hereunder, the functions of the vehicle's intake device 50 will be described.

Figure 8A:
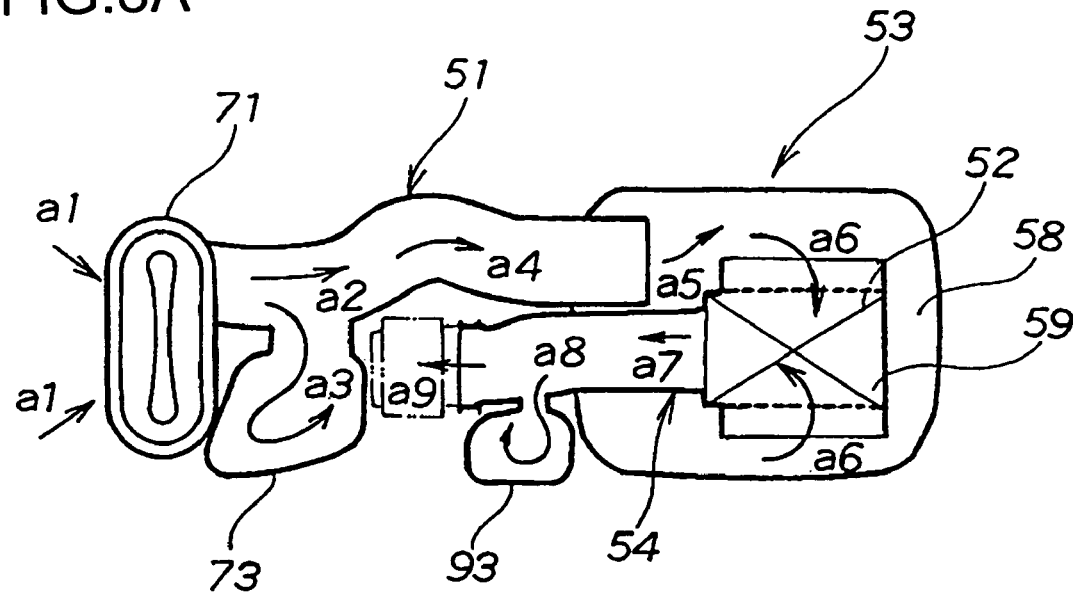
FIG. 8 is an illustration for describing the first function of the intake device of the present invention.

FIGS. 8A and B show illustrations for describing the first function of the vehicle's intake device of the present invention respectively. FIG. 8A shows an air flow at a top view of the device and FIG. 8B shows the air flow at a side view of the device.

In FIG. 8A, air is taken into the intake pipe 51 from the opening cover (louver) 71 as shown by arrows a1, then flown in the intake pipe 51 as shown by an arrow a2, then into the first resonator 73 as shown by an arrow a3. Because the air is flown in the first resonator 73 as shown by an arrow a3, the first resonator 73 can function as if it has a larger diameter intake pipe 51, thereby the air blow resistance is reduced. This is why the intake sounds resonant with a specific frequency is reduced.

And, the air is flown in the intake pipe 51 as shown by an arrow a4, then into the first chamber 58 of the air cleaner case 53 as shown by an arrow a5. After that, the air is flown from the first chamber 58 into the second chamber 59 as shown by an arrow a6. The air is then cleaned by the air cleaner 52 installed in the second chamber 59 and the cleaned air is flown into the connection pipe 54 as shown by an arrow a7, then into the second resonator 93 as shown by an arrow a8. Because the air is flown into the second resonator 93 in an arrow direction a8, so that the second resonator 93 can function as if it has a larger diameter connection pipe 54. The air blow resistance is thus reduced. This is why intake sounds resonant with another specific frequency is reduced.

Figure 8B:
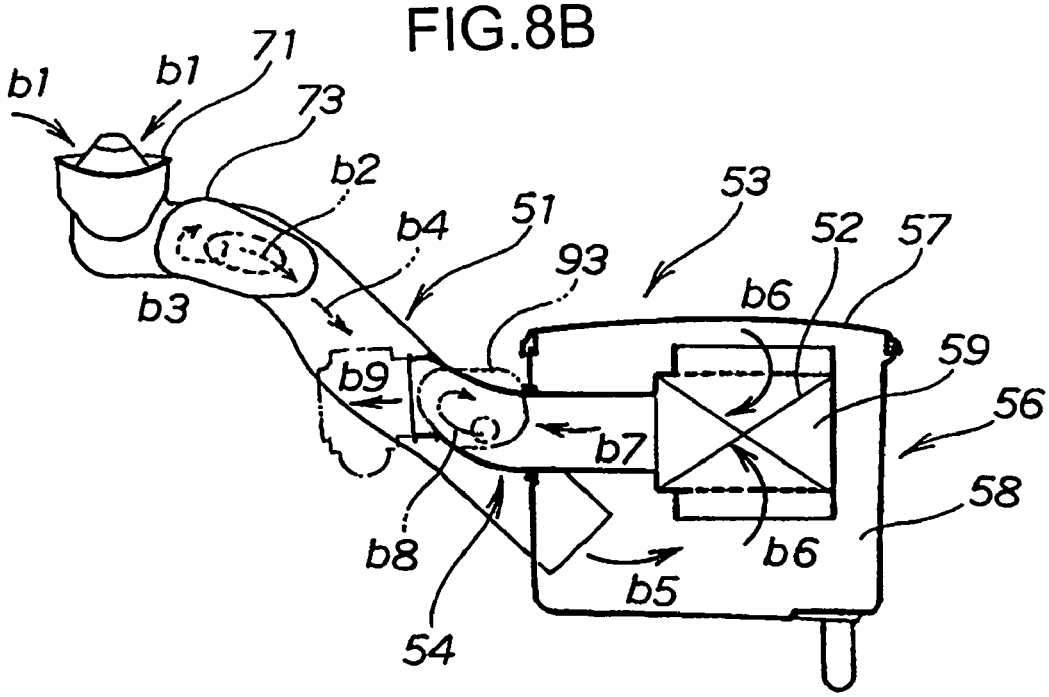

In FIG. 8B, the air flows as shown at the side view of the vehicle's intake device. Arrows b1 to b9 correspond to the arrows a1 to a9 in FIG. 8A. The air flow shown in FIG. 8B is the same as that shown in FIG. 8A, so the description for the air flow will be omitted here.

Figure 9A:
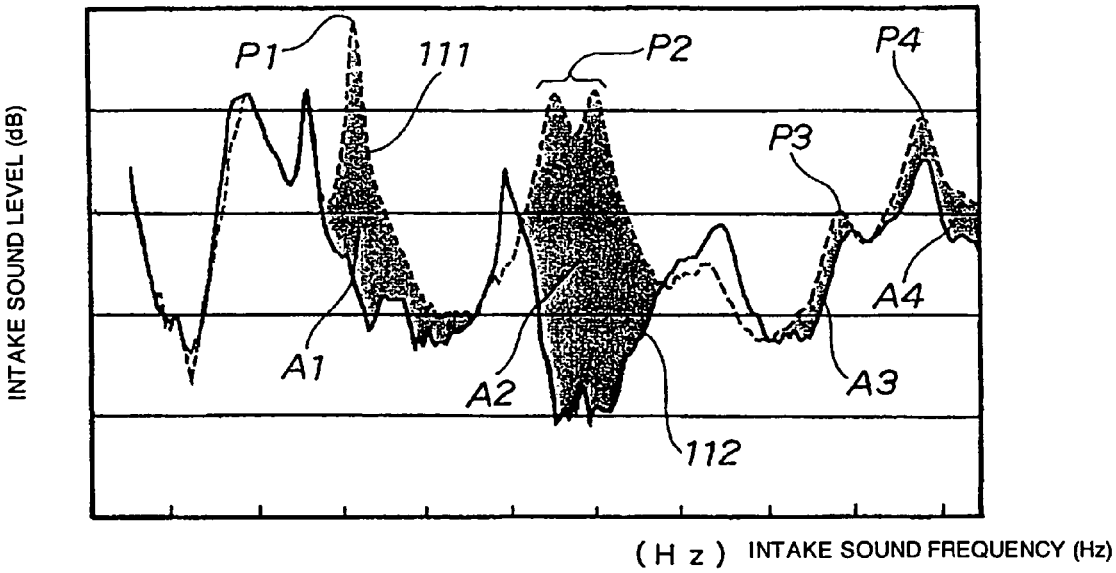
FIG. 9 is an illustration for describing the second function of the intake device of the present invention.
Figure 9B:
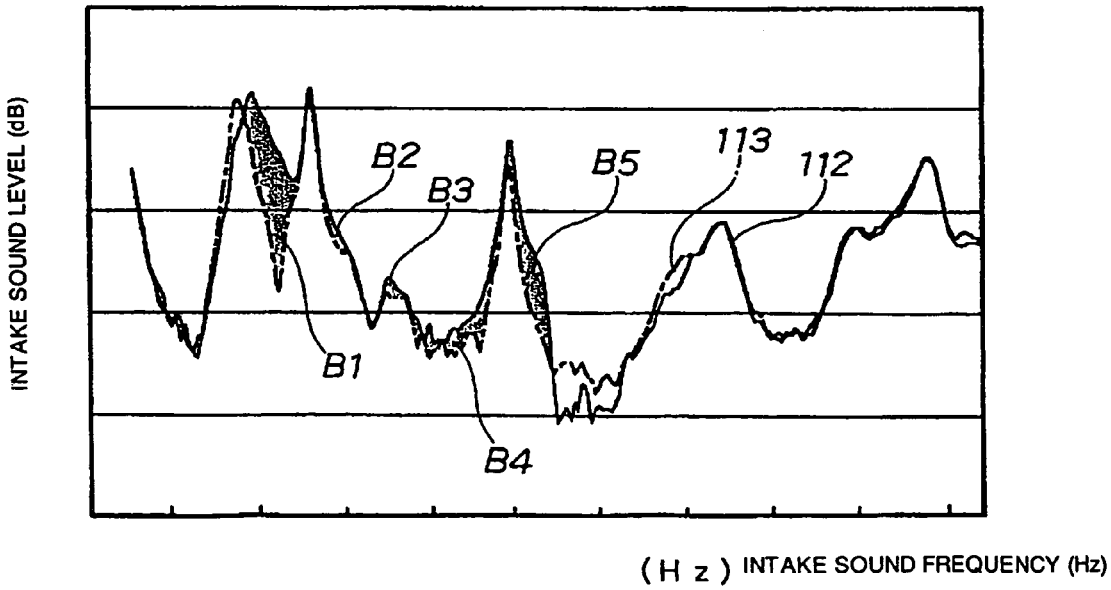

FIGS. 9A and 9B show illustrations for the second function of the vehicle's intake device of the present invention. The horizontal axis denotes the frequencies (Hz) of intake sounds and the vertical axis denotes the intake sound levels (dB). FIG. 9A shows the effect of the first resonator 73 for intake sound reduction and FIG. 9B shows the effect of a combination of the first and second resonators 73 and 93 for intake sound reduction (the same reference numerals as those shown in FIG. 6 are used here).

In FIG. 9A, the intake sound frequency characteristic 111 shown by a dashes line denotes intake sound levels measured in the vehicle's intake device 50 from which the first and second resonators 73 and 93 are removed and the openings 79 and 96 of the first and second resonators 73 and 93 are closed. Each intake sound frequency of the vehicle's intake device 50 is used as a parameter.

As a result, the intake sound frequency characteristic 111 is recognized significantly in the measured intake sound frequencies, that is, the first to fourth resonant frequencies P1 to P4.

The intake sound frequency characteristic 112 shown by a solid line denotes the intake sound reduction characteristic of the first resonator 73, which is intake sound levels measured in the vehicle's intake device 50 from which only the second resonator 93 is removed and the second resonator side opening 96 is closed. Each intake sound frequency of the vehicle's intake device 50 is used as a parameter.

In other words, the shaded areas A1 to A4 denote intake sound reduction levels of the first resonator 73. In the first and second resonant frequencies, the intake sound is reduced significantly as shown in the areas A1 and A2. In the third and fourth resonant frequencies P3 and P4, the intake sound is reduced slightly as shown in the areas A3 and A4.

In FIG. 9B, the intake sound frequency characteristic 112 shown by a solid line has the same curve as that of the intake sound frequency characteristic 112 in FIG. 9A.

The intake sound frequency characteristic 113 shown by an alternate long and short dash line denotes intake sound levels measured by using both of the second resonator 93 and the first resonator 73 and returning the vehicle's intake device 50 into the perfect state. Each intake sound frequency is used as a parameter. In other words, the intake sound frequency characteristics 112 and 113 can be compared with each other to know the effect of the second resonator for intake sound reduction.

In other words, the shaded areas B1 to B5 denote the effects of the second resonator 93 for intake sound reduction. More particularly, it will be understood that the intake sound reduction is achieved at lower frequencies than that of the first resonant frequency P1 shown in FIG. 9A (refer to the area B1).

As shown in FIGS. 9A and 9B, in the vehicle's intake device 50, the intake pipe 51 is provided with the first resonator 73 for reducing intake sounds. The device 50 can thus reduce intake sounds resonant with one specific frequency. And, the connection pipe 54 is provided with the second resonator 93, so that the device 50 can reduce intake sounds resonant with another specific frequency. This is why the device 50 can reduce intake sounds in a plurality of frequency bands simultaneously.

In the above example, as shown in FIG. 6, while the intake pipe 51 is provided with one first resonator 73 and the connection pipe 54 is provided one second resonator 93, the number of resonators is not limited only to two total. For example, the intake pipe 51 may be provided with two or more first resonators and the connection pipe 54 may be provided with two or more second resonators. The shape, size, disposition, and protruding direction of those first and second resonators may be decided freely.

In the above example, as shown in FIG. 6, while the intake pipe 51 is provided with a separated first resonator 73 and the connection pipe 54 is provided with a separated second resonator 93, the first resonator 73 may be united with the intake pipe 51 and the second resonator 93 may be united with the connection pipe 54.

Furthermore, in the above example, as shown in FIG. 1, the vehicle's intake device 50 is installed in an off-road vehicle 10. However, the vehicle is not limited to such an off-road one; it may be any of motorcycles, three-wheeled vehicles, or four-wheeled vehicles.

While the present invention has been described with reference to several particular implementations, those skilled in the art will recognize that many changes may be made hereto without departing from the spirit and scope of the present invention.

We claim:

1. An off road vehicle comprising:

a vehicle frame including right and left main frames that extend forwardly and rearwardly from a center of the vehicle;

a power unit attached to a middle portion of the vehicle frame, the power unit including an engine that is disposed between the right and left main frames;

a fuel tank positioned above the power unit and attached to the vehicle frame;

an intake device disposed between the right and left main frames, the intake device including:

an intake pipe;

an air cleaner case in fluid communication with the intake pipe, the case; having a width;

a connection pipe in fluid communication with the air cleaner case;

the intake pipe and the connection pipe extend from the same side of the air cleaner case;

a carburetor attached to the connection pipe;

a space between the air cleaner case and the carburetor, the space being located to a side of the connection pipe;

a first resonator attached to the intake pipe; and a second resonator attached to the connection pipe and disposed in the space, and the first and second resonators are each disposed within the width of the air cleaner case;

a vehicle seat positioned above the intake device and attached to the vehicle frame, and the intake pipe is positioned above the engine and between the fuel tank and the seat.

2. The off-road vehicle of claim 1, wherein the first resonator and the second resonator reduce intake sound levels.

3. The off-road vehicle of claim 2, wherein the first resonator reduces intake sound levels at a frequency range different than the second resonator.

4. The off-road vehicle of claim 1, further comprising an air cleaner disposed within the air cleaner case, wherein the air cleaner is attached to the intake pipe.

5. The off-road vehicle of claim 1, wherein the off-road vehicle has a forward direction in which the off-road vehicle travels, and wherein the intake pipe and the connection pipe extend generally forwardly from the air cleaner case, and the carburetor, the first resonator, and the second resonator are located forward of the air cleaner case.

6. An intake device for an off-road vehicle comprising:

an intake pipe;

an air cleaner case in fluid communication with the intake pipe, the case having a width;

a connection pipe in fluid communication with the air cleaner case;

the intake pipe and the connection pipe extend from the same side of the air cleaner case;

a carburetor attached to the connection pipe; and a space between the air cleaner case and the carburetor;

a first resonator attached to the intake pipe; and a second resonator attached to the connection pipe and located within the space;

wherein the first resonator is located at a side of the intake pipe and the first and second resonators are each disposed within the width of the air cleaner case;

wherein the intake device and an engine of the vehicle are disposed between right and left main frames of a frame of the vehicle that extend forwardly and rearwardly from a center of the vehicle, a fuel tank is positioned above the engine and is attached to the frame, a vehicle seat is positioned above the intake device and is attached to the frame, and the intake pipe is positioned above the engine and between the fuel tank and the vehicle seat.

7. The intake device of claim 6, wherein the first resonator reduces intake sound levels at a frequency range different than the second resonator.

8. The intake device of claim 6, wherein the second resonator is disposed in front of the air cleaner case and to the side of the connection pipe.

9. The intake device of claim 6, wherein the off-road vehicle has a forward direction in which the off-road vehicle travels, and wherein the intake pipe and the connection pipe extend generally forwardly from the air cleaner case, and the carburetor, the first resonator, and the second resonator are located forward of the air cleaner case.

10. An intake device for an off-road vehicle comprising:

an intake pipe;

an air cleaner case in fluid communication with the intake pipe, the case having a width;

a connection pipe in fluid communication with the air cleaner case;

a carburetor attached to the connection pipe;

a space between the air cleaner case and the carburetor, the space being located to a side of the connection pipe;

a first resonator attached to the intake pipe; and a second resonator attached to the connection pipe and disposed in the space, and the first and second resonators are each disposed within the width of the air cleaner case, and the first and second resonators are each disposed on the same side of the intake pipe and the connection pipe and disposed at different vertical heights relative to each other;

wherein the intake device and an engine of the vehicle are disposed between right and left main frames of a frame of the vehicle that extend forwardly and rearwardly from a center of the vehicle, a fuel tank is positioned above the engine and is attached to the frame, a vehicle seat is positioned above the intake device and is attached to the frame, and the intake pipe is positioned above the engine and between the fuel tank and the vehicle seat.

* * * * *